US010662721B2

(12) United States Patent
Deere et al.

(10) Patent No.: US 10,662,721 B2
(45) Date of Patent: May 26, 2020

(54) MATING CONNECTOR FOR DOWNHOLE TOOL

(71) Applicant: TOLTEQ GROUP, LLC, Cedar Park, TX (US)

(72) Inventors: Paul R. Deere, Cedar Park, TX (US); David Chandos, Salado, TX (US); Patrick Mendez, Cedar Park, TX (US)

(73) Assignee: Tolteq Group, LLC, Cedar Park, TX (US)

( * ) Notice: Subject to any disclaimer, the term of this patent is extended or adjusted under 35 U.S.C. 154(b) by 200 days.

(21) Appl. No.: 15/306,898

(22) PCT Filed: Apr. 29, 2015

(86) PCT No.: PCT/US2015/028294
§ 371 (c)(1),
(2) Date: Oct. 26, 2016

(87) PCT Pub. No.: WO2015/171400
PCT Pub. Date: Nov. 12, 2015

(65) Prior Publication Data

US 2017/0044840 A1 Feb. 16, 2017

Related U.S. Application Data

(60) Provisional application No. 61/988,282, filed on May 4, 2014.

(51) Int. Cl.
*E21B 17/02* (2006.01)
*H01R 13/05* (2006.01)
(Continued)

(52) U.S. Cl.
CPC ..... *E21B 17/028* (2013.01); *E21B 17/046* (2013.01); *H01R 9/0503* (2013.01);
(Continued)

(58) Field of Classification Search
CPC ... E21B 17/028; E21B 17/046; H01R 13/625; H01R 9/0503
See application file for complete search history.

(56) References Cited

U.S. PATENT DOCUMENTS 3,719,918 A 3/1973 Kerr
4,085,993 A * 4/1978 Cairns ..... H01R 13/523 439/201
(Continued)

FOREIGN PATENT DOCUMENTS

CN 1199254 A 11/1998
CN 103138062 A 6/2013
(Continued)

OTHER PUBLICATIONS

International Application No. PCT/US2015/028294 International Search Report and Written Opinion dated Aug. 5, 2015 (7 pages).
(Continued)

*Primary Examiner* — Robert E Fuller
*Assistant Examiner* — Lamia Quaim
(74) *Attorney, Agent, or Firm* — Conley Rose, P.C.

(57) ABSTRACT

An apparatus for electrically connecting two downhole components configured to be disposed in a borehole. The apparatus includes two complementing tool connectors which each have a corresponding electrical connector. The tool connectors may mate using a bayonet and slot connection. The slot may be L-shaped or l-shaped. The slot may be configured for straight or rotational engagement of the tool connectors. The electrical connectors may mate using concentric contacts that share the same axis. The electrical connectors are configured to rotate without stressing the contacts during assembly, disassembly, and drilling operations. The electrical connectors may support two or more contacts.

11 Claims, 12 Drawing Sheets

(51) Int. Cl.

| | |
|---|---|
| ***H01R 24/38*** | (2011.01) |
| ***H01R 13/213*** | (2006.01) |
| ***E21B 17/046*** | (2006.01) |
| ***H01R 13/625*** | (2006.01) |
| ***H01R 9/05*** | (2006.01) |

(52) U.S. Cl.
CPC ..... *H01R 13/213* (2013.01); *H01R 13/625* (2013.01); *H01R 24/38* (2013.01)

(56) References Cited

U.S. PATENT DOCUMENTS

| | | | | |
|---|---|---|---|---|
| 4,444,453 | A | 4/1984 | Kirby et al. | |
| 4,734,050 | A | 3/1988 | Negre et al. | |
| 5,137,469 | A | 8/1992 | Carpenter et al. | |
| 5,544,275 | A | 8/1996 | Ebbing et al. | |
| 5,906,511 | A * | 5/1999 | Bozzer | H01R 24/38 439/579 |
| 6,644,410 | B1 | 11/2003 | Lindsey-Curran et al. | |
| 8,287,005 | B2 | 10/2012 | Leslie et al. | |
| 2003/0082942 | A1 | 5/2003 | Wlos | |
| 2008/0160833 | A1 | 7/2008 | Shipalesky | |
| 2012/0171884 | A1 * | 7/2012 | Dang | H01R 13/6463 439/310 |
| 2013/0025419 | A1 | 1/2013 | Opstad | |
| 2014/0112699 | A1 | 4/2014 | Lewkoski | |

FOREIGN PATENT DOCUMENTS

| | | | | |
|---|---|---|---|---|
| CN | 103390816 | A | 11/2013 | |
| CN | 103397852 | A | 11/2013 | |
| GB | 1529652 | A | 10/1978 | |
| RU | 2401932 | C2 | 10/2010 | |
| SU | 1146749 | A | 3/1985 | |
| WO | 92/20948 | A1 | 11/1992 | |
| WO | WO-9220948 | A1 * | 11/1992 | E21B 33/038 |
| WO | 2004/092633 | A2 | 10/2004 | |

OTHER PUBLICATIONS

European Search Report dated Dec. 18, 2017, for European Application No. 15789556.6 (7 p.).
Chinese Patent Application No. 201580023143.7 Office Action dated Jun. 4, 2018 (18 pages).
Office Action dated Aug. 22, 2018 for Russian Patent Application No. 2016144513 (17 pages).
Chinese Patent Application No. 201580023143.7 Third Office Action dated Sep. 2, 2019 (17 pages).
European Patent Application No. 15789556.6 Examination Report dated Jul. 4, 2019 (6 pages).
Office Action and Search Report dated Feb. 22, 2019 for Chinese Patent Application No. 201580023143.7 (18 pages).

* cited by examiner

MATING CONNECTOR FOR DOWNHOLE TOOL

CROSS REFERENCE TO RELATED APPLICATIONS

This application is a 35 U.S.C. § 371 national stage entry of PCT/US2015/028294, filed Apr. 29, 2015, and entitled "Mating Connector For Downhole Tool," which claims the benefit of Provisional U.S. Patent Application No. 61/988,282, filed May 4, 2014, and entitled "Mating Connector For Downhole Tool" which are incorporated here by reference in their entireties for all purposes.

BACKGROUND OF THE DISCLOSURE

1. Field of the Disclosure

This disclosure relates to the field of downhole tools associated with rotary drilling in earth formations, especially to reduction of damage to electrical connections during assembly, disassembly, and drilling operations.

2. Description of the Related Art

Rotary drilling in earth formations is used to form boreholes for obtaining materials in the formations, such as hydrocarbons. Rotary drilling involves a drill bit disposed on a drilling end of a drill string that extends from the surface. The drill string is made up of a series of tubulars that are configured to allow fluid to flow between the surface and earth formation. Above and proximate to the drill bit may be formation and/or borehole measurement tools for measurement-while-drilling. Multiple tools may be grouped together as a bottom hole assembly.

During rotation of the drill bit, downhole tools in the bottom hole assembly may be subjected to vibrations and mechanical shocks that can damage the measurement tools, communication along the drill string, or connections between downhole tools and other downhole components. Electrical connections of downhole tools often involve pins that may be damaged during drilling operations. Failure of an electrical connection may disable one or more downhole tools requiring abandonment of the drilling run in order to diagnose and change out or repair the electrical connection.

Further, some electrical connections may be damaged during assembly or disassembly of the drill string. Tool breakage during set up and shutdown also contribute to cost and time delays for the current or future tool run.

There is a need for a tool connection that protects the electrical connectors during assembly, disassembly, and drilling operations. There is a need for a tool connector configured to allow assembly and disassembly without tools in the field. There is need for an electrical connection that can endure torsional forces without pin wear or breakage. Further, there is a need for a tool connection that augments the mechanical strength of the bottom hole assembly.

BRIEF SUMMARY OF THE DISCLOSURE

In aspects, the present disclosure is related downhole tools associated with rotary drilling in earth formations. Specifically, the present disclosure is related to reducing damage and wear due to mechanical shock and vibration.

One embodiment according to the present disclosure includes an apparatus for transmitting data across a tool joint connection configured to be disposed in a borehole, the apparatus comprising: a first data transmission element connected to a first downhole component having first tool connector with a bayonet plug disposed on an outer surface of the first tool connector; a second data transmission element connected to a second downhole component having a second tool connector with a slot configured to receive the bayonet plug of the first tool connector; wherein the first data transmission element comprises one of a male coaxial connector and a female coaxial connector, and the second data transmission element comprises the other of the male coaxial connector and the female coaxial connector, and wherein an electrical connection between the female coaxial connector and the male coaxial connector is formed during the formation of the tool joint connection by the mating of the first tool connector and the second tool connector. In some aspects, the slot may be J-shaped. The apparatus may include a compression spring disposed with one of the data transmission elements and configured to maintain an electrical connection between the data transmission elements. In some aspects, the apparatus may include a second compression spring disposed on the other of the data transmission elements and configured to maintain the electrical connection between the data transmission elements. The first tool connector and the second tool connector may be configured to receive one or more cover plates when in a mated position. The electrical connection may include coaxial connectors with three or more concentric contacts. In some aspects, the coaxial connectors may have four or more concentric contacts.

Another embodiment according to the present disclosure may include a method for forming a joint tool connection configured to be disposed in a borehole, wherein the joint tool connection comprises: a first data transmission element connected to a first downhole component having first tool connector with a bayonet plug disposed on an outer surface of the first tool connector; and a second data transmission element connected to a second downhole component having a second tool connector with a slot configured to receive the bayonet plug of the first tool connector; wherein the first data transmission element comprises one of a male coaxial connector and a female coaxial connector, and the second data transmission element comprises the other of the male coaxial connector and the female coaxial connector, and wherein an electrical connection between the female coaxial connector and the male coaxial connector is formed during the formation of the tool joint connection by the mating of the first tool connector and the second tool connector; the method comprising: moving the bayonet plug along a path formed by the slot from a first position to a second position while simultaneously moving two electrical connections into a mated position. The method may also include a step of moving the bayonet plug from a second position to a locked position using the first compression spring. And the step of moving the bayonet plug to the second position may include rotating the first tool connector and the second tool connector relative to one another.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

A better understanding of the present disclosure can be obtained with the following detailed descriptions of the various disclosed embodiments in the drawings, which are given by way of illustration only, and thus are not limiting the present disclosure, and wherein.

DETAILED DESCRIPTION OF THE DISCLOSURE

Figure 1:
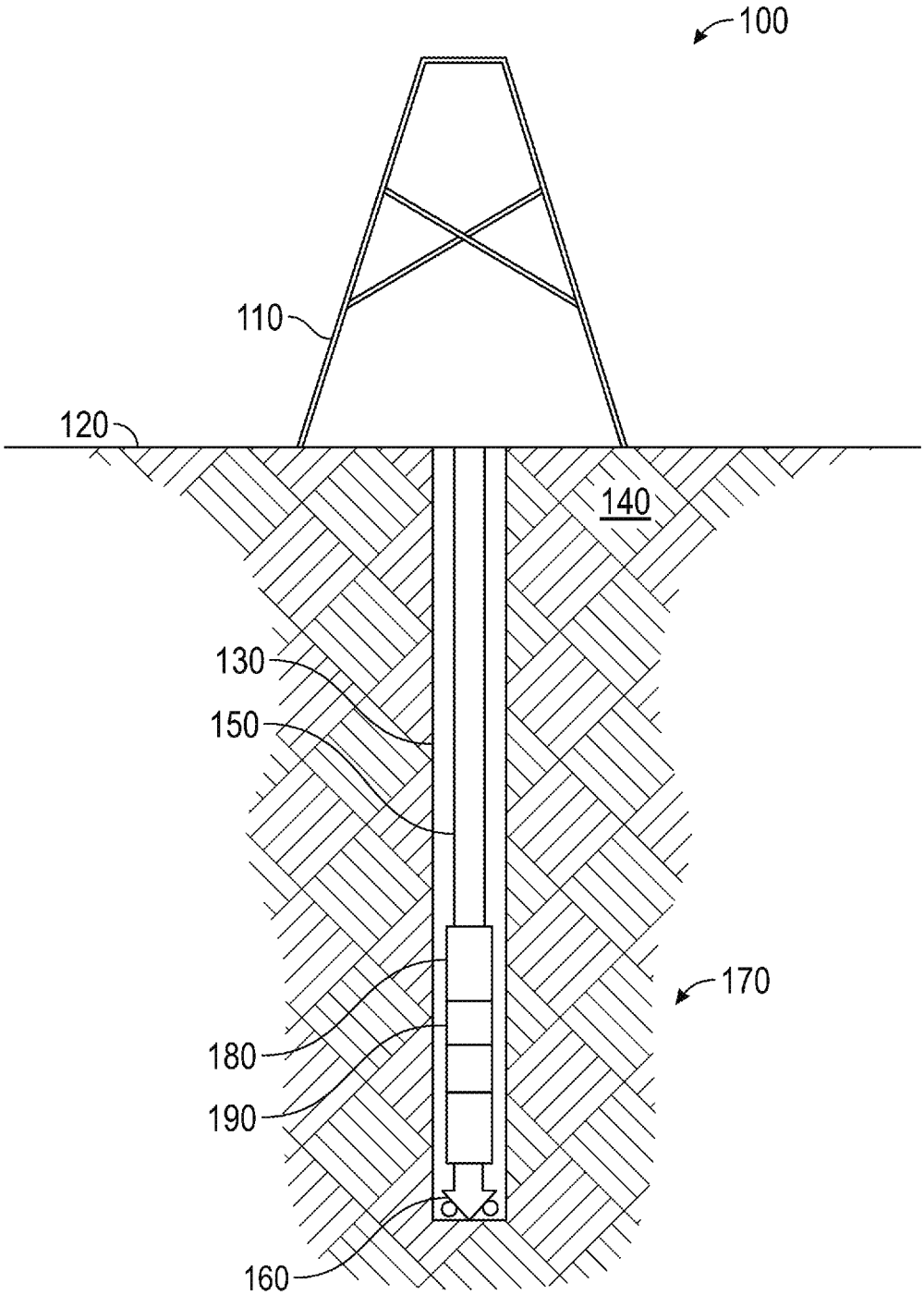
FIG. 1 is a diagram of a drilling system with a bottom hole assembly configured for use in a borehole that includes a connection according to one embodiment of the present disclosure.

In aspects, the present disclosure is related to downhole drilling operations. Specifically, the present disclosure is related to maintaining and protecting electrical continuity between downhole components during assembly and drilling operations. The present invention is susceptible to embodiments of different forms. There are shown in the drawings, and herein will be described in detail, specific embodiments with the understanding that the present invention is to be considered an exemplification of the principles and is not intended to limit the present invention to that illustrated and described herein.

FIG. 1 shows a diagram of a drilling system 100 that includes a drilling rig 110 disposed on a surface 120 and above a borehole 130 in an earth formation 140. Disposed in the borehole 130 is drill string 150 with a drill bit 160 at the bottom of the borehole 130. Above the drill bit 160 is a bottom hole assembly 170 that includes downhole components 180, 190. The downhole components 180, 190 may be configured for measurement, communication, and other operations during drilling. The downhole components 180, 190 are configured for an electrical connection to be made between the downhole components. The electrical connection may be suitable to communicate data, power, or both.

Figure 2A:
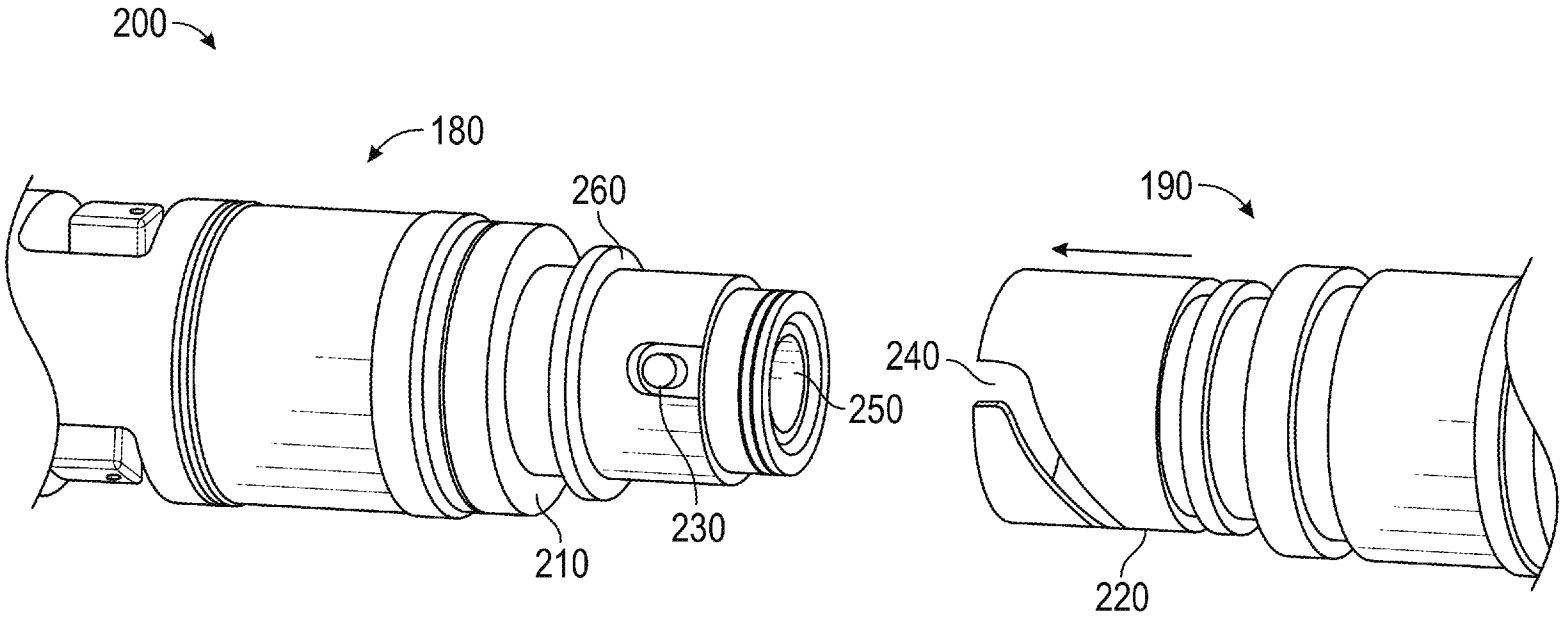
FIG. 2A is a 3-D view of a downhole component with a bayonet tool connector and second downhole component with a corresponding slot for mating with the bayonet tool connector according to one embodiment of the present disclosure.

FIGS. 2A-2E show 3-D views of a connection 200 of the first downhole component 180 and the second downhole component 190. FIG. 2A shows the first component 180 with a first tool connector 210 disposed on one end, and the second component 190 with a second tool connector 220 disposed on one end. The first tool connector 210 includes a generally cylindrical outer surface with a bayonet plug 230 on its outer surface and a stop ring 260 with a larger diameter than the adjacent portions of the outer surface. The stop ring 260 is a raised portion of the first tool connector 210. The second tool connector 220 is also generally cylindrical and includes a slot 240 configured to mate with the bayonet plug 230. The second tool connector 220 has an interior diameter that is larger than the exterior diameter of the end of the first tool connector 210 but smaller than the exterior diameter of the stop ring 260. The first tool connector 210 and the second tool connector 220 are configured to house a female electrical connector 250 and a male electrical connector 255 (see FIG. 3). While shown with the female electrical connector 250 disposed on the first tool connector 210 and the male electrical connector 255 (not specifically shown in FIGS. 2A-2E; however, see FIG. 3) disposed on the second tool connector 220, it is contemplated that the connectors 250, 255 may be switched.

Figure 2B:
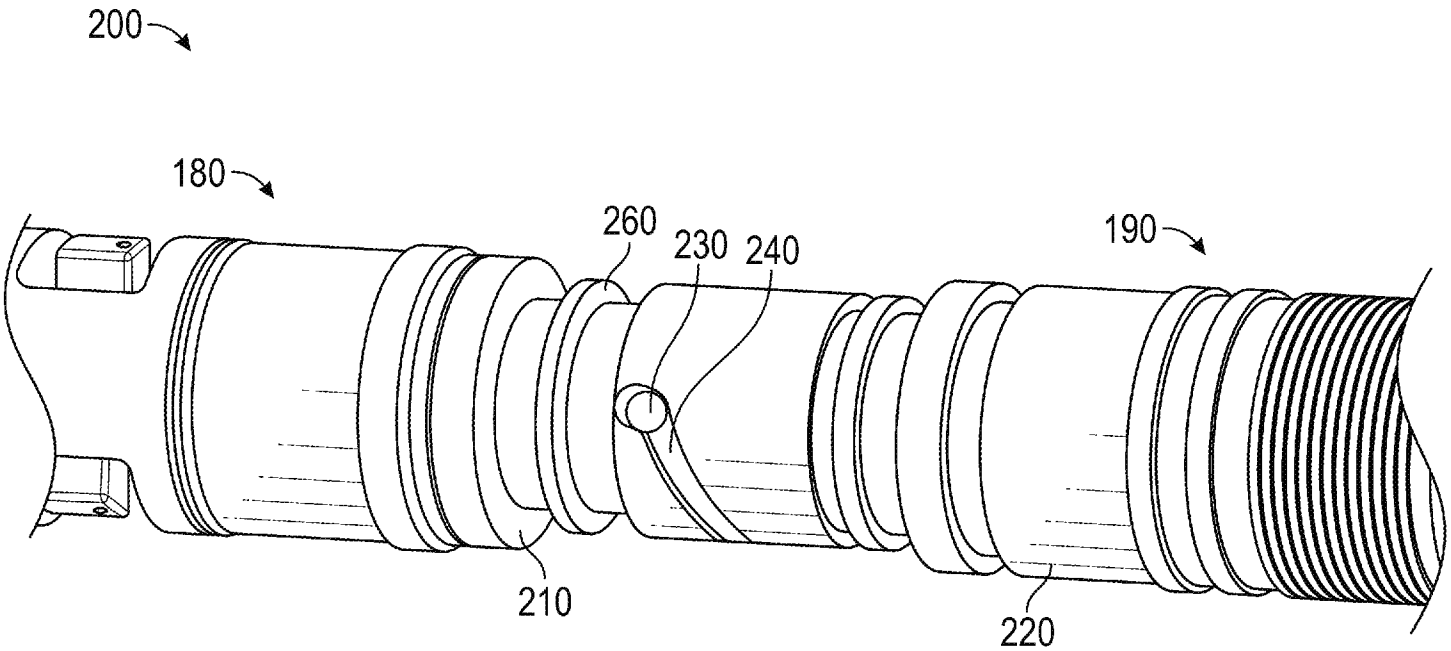
FIG. 2B is a 3-D view of the components from FIG. 2A beginning to form a connection.

FIG. 2B shows the connection 200 being formed. The end of the second connector 210 is configured to slidingly engage the end of the first connector 220 when the bayonet plug 230 is aligned with the slot 240. The slot 240 may be L-shaped or J-shaped. When using a J-shaped slot, the slot 240 may define a first position where the bayonet plug 230 enters the slot 240 and a second position where the bayonet plug 230 must change its path to move further down the length of the slot 240 (usually the maximum position that may be achieved through rotation). The slot 240 will also have a locked position, beyond the second position, which, when reached, prevents rotation of the tool connectors 210, 220. The final movement from the second position to the locked position in the slot 240 may be performed through the action of the biasing element 470 (see FIG. 4D). As shown, the slot 240 defines a path that requires the connectors 210, 220 to rotate 90 degrees relative to one another during engagement; however, this is exemplary and illustrative only. The defined path may require any degree of rotation during the engagement, including 0 degrees (straight path), 360 degrees, and variations in between as would be understood by a person of ordinary skill in the art. With the bayonet plug 230 and its corresponding slot 240 provided, the two connectors 210, 220 may be engaged in the field without tools.

Figure 2C:
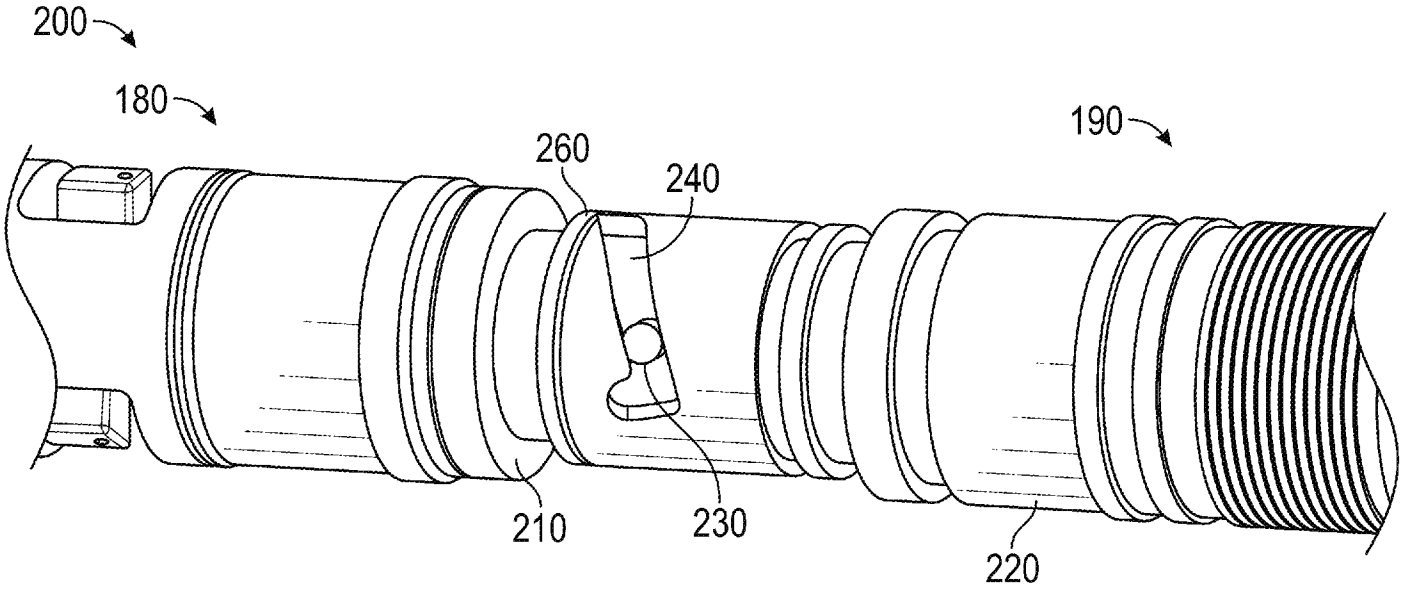
FIG. 2C is a 3-D view of the components from FIG. 2A with the bayonet plug in an intermediate position in the slot.

FIG. 2C shows the connection 200 proceeding, and the bayonet plug 230 in an intermediate position within the slot 240. In order for the connection formation to continue, one or both of the tool connectors 210, 220 must rotate relative to the other while moving closer together, as guided by the slot 240.

Figure 2D:
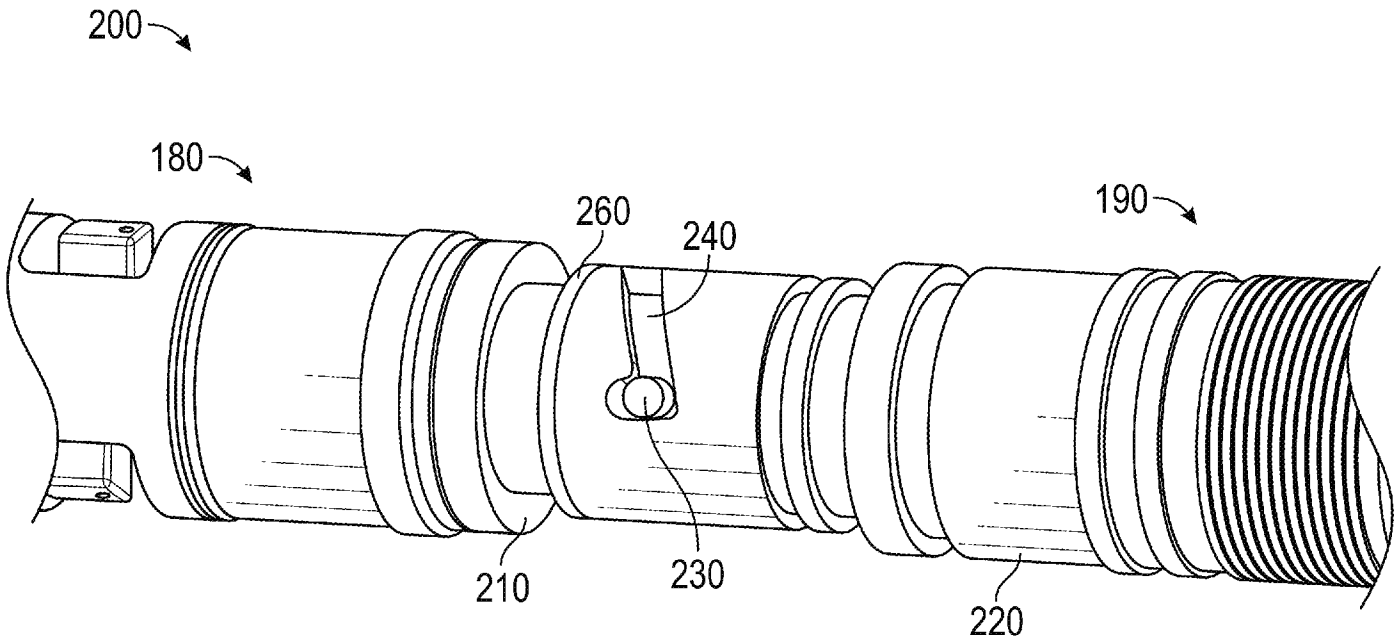
FIG. 2D is a 3-D view of the components from FIG. 2A with the bayonet plug at the end of the slot while the components are fully pressed together.

FIG. 2D shows the bayonet plug 230 at the end of intermediate section of the slot 240. If the slot were L-shaped, this would be the final position of the bayonet plug 230; however, since a J-shaped slot is shown, the slot 240 is configured to allow the tool connectors 210, 220 to "lock" in position by moving outward.

Figure 2E:
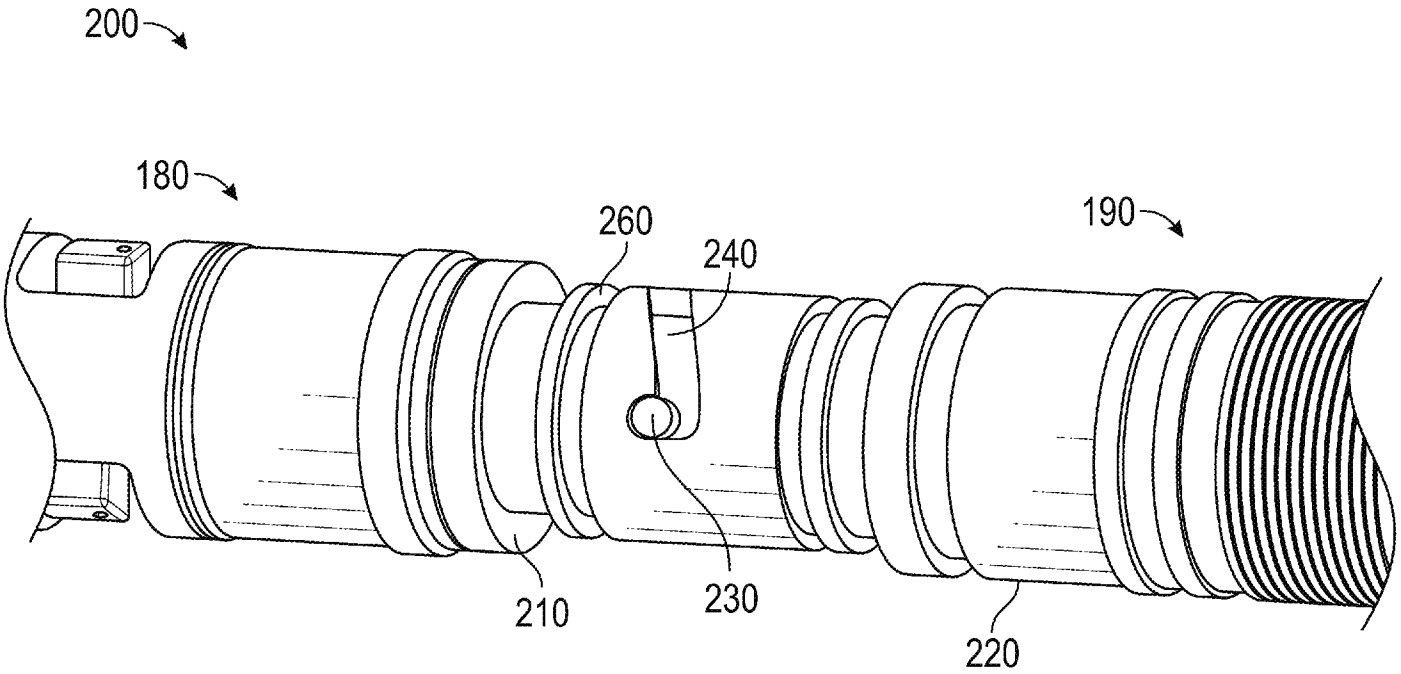
FIG. 2E is a 3-D view of the components from FIG. 2A with the bayonet plug at the end of the slot after release of the pressure on the components.

FIG. 2E shows the connection 200 after the tool connectors 210, 220 have moved outward until the bayonet plug 230 is restrained by the longitudinal limit of the slot 240. In some embodiments, the bayonet plug 230 may be maintained in this position by compression force from a biasing element, such as, but not limited to, spring 470 (see FIG. 4D). The tool connectors 210, 220 can be disengaged by overcoming the compression force and then rotating to move the bayonet plug 230 out of the slot 240 along the path defined by the slot 240. Typically, the tools 180, 190 will be enclosed in a tubular component that will provide some degree of protection against disconnection due to mechanical shock and vibration; however, the use of the bayonet plug 230 and the slot 240 may provide additional resistance against disconnection when the bottom hole assembly 170 is subjected to mechanical forces that could potentially sever or separate the electrical connectors 250, 255. The material structure and composition of the tool connectors 210, 220 may be selected to ensure a robust tool connection for the borehole environment.

Figure 3:
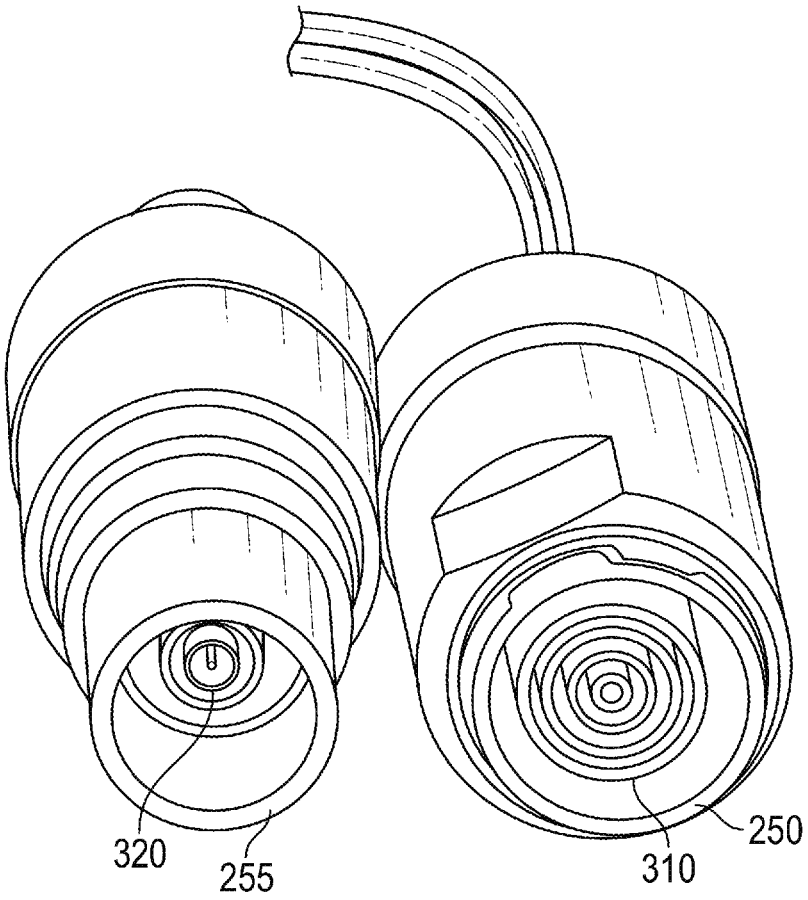
FIG. 3 is a 3-D view of the electrical connectors for each of the components of FIG. 2A according to one embodiment of the present disclosure.

FIG. 3 shows a view of the electrical connectors 250, 255 facing their contacts. The electrical connectors 250, 255 are configured to rotate relative to one another without stressing the electrical connections. During assembly and operations, torsional forces may rotate electrical connector pairs relative to one another resulting in stressed, damaged, or broken pins; however, electrical connectors 250, 255 may rotate relative to each other while maintaining an electrical connection. Electrical connectors 250, 255 may be coaxial connectors. The female electrical connector 250 may include a plurality of concentric contacts 310. Correspondingly, the male electrical connector 255 may include a plurality of concentric contacts 320 configured to mate with the contacts 310. The connectors 250, 255 may be configured to operate in a borehole environment, including a temperature range of about −55 degrees C. to about 225 degrees C. In other aspects, the connectors 250, 255 may be configured to operate in a temperature range of about −50 degrees C. to about 205 degrees C. In still other aspects, the connectors 250, 255 may be configured to operating in a temperature range of about 0 degrees C. to about 175 degrees C. The connectors 250, 255 may have two or more concentric contacts. In some embodiments, the connectors 250, 255 may have three or more concentric contacts. Further, in some embodiments, the connectors 250, 255 may have four or more concentric contacts.

Figure 4A:
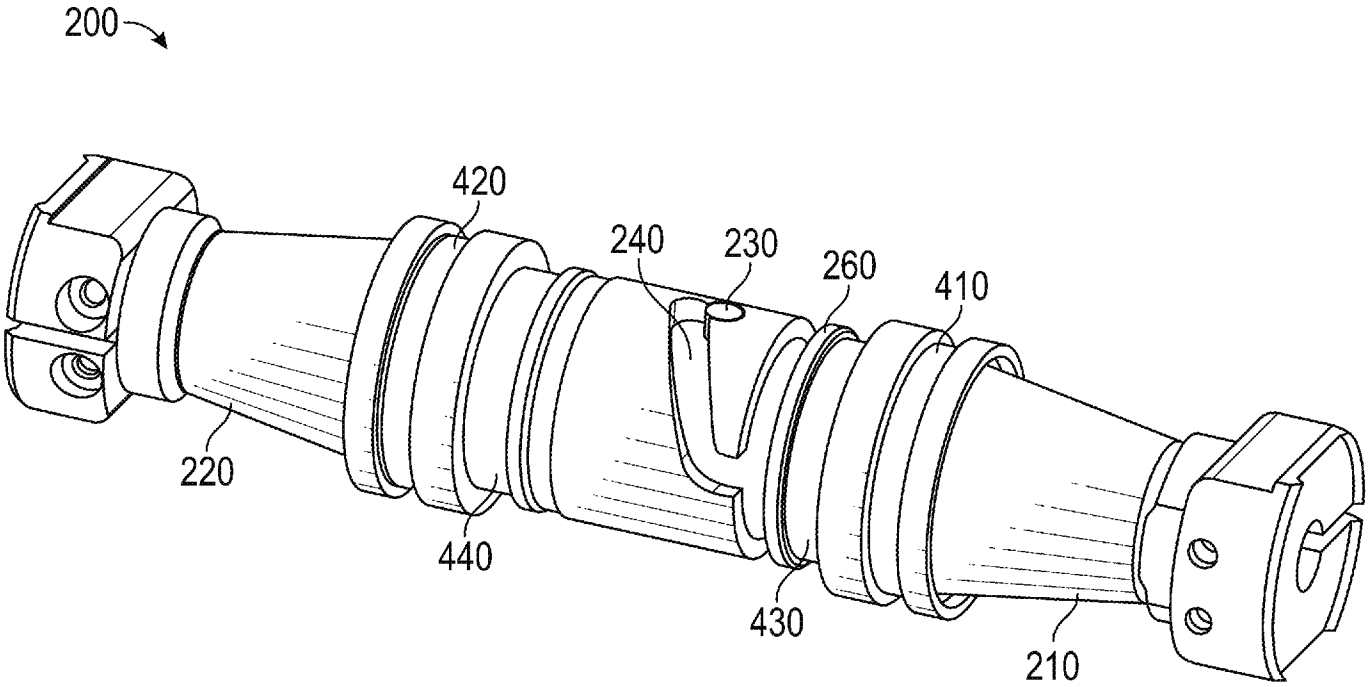
FIG. 4A is a 3-D view of the connection prior to closure of the half-shell according to one embodiment of the present disclosure.

FIG. 4A shows a 3-D view of the connection 200 separate from the downhole components 180, 190. Each of the tool connectors 210, 220 has a circular recessed area 410,420 configured to receive an O-ring, which is designed to protect the interior of the connection 220 from contamination by borehole fluids and debris. The tool connectors 210, 220 also include circular recessed areas 430,440 configured to receive cover shells 450 (see FIG. 4B).

Figure 4B:
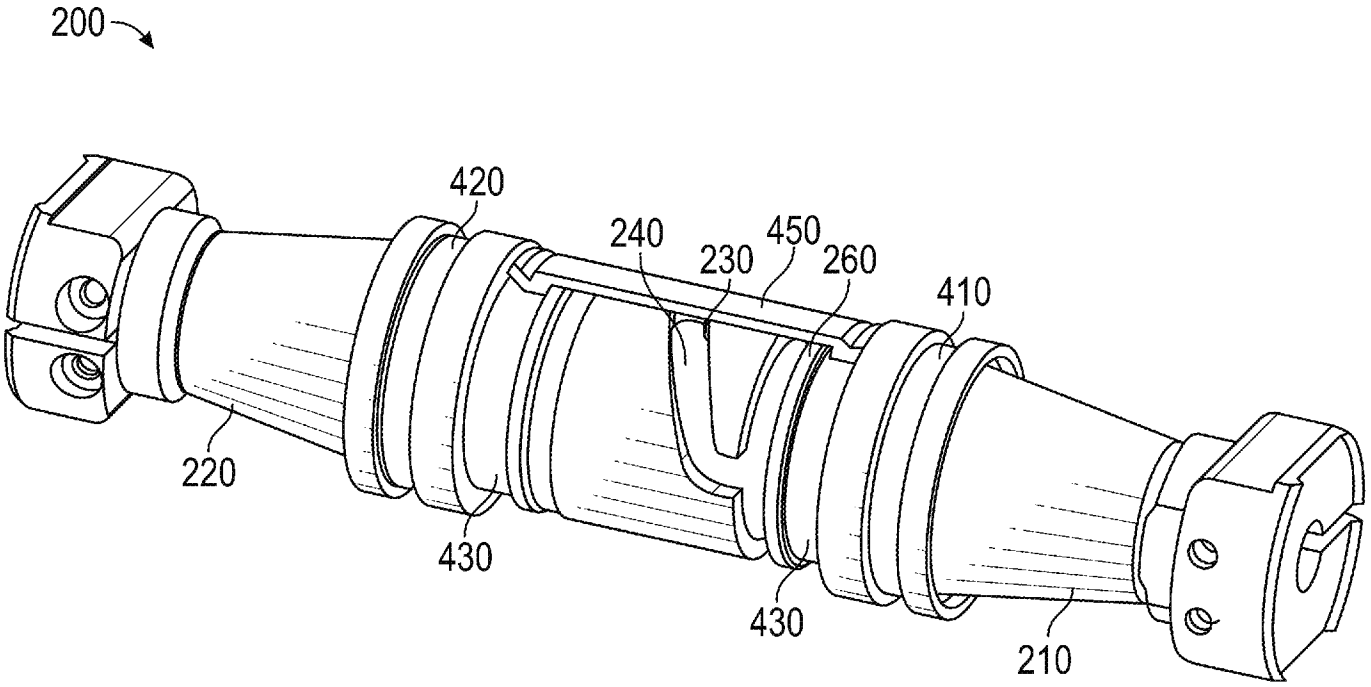
FIG. 4B is a 3-D view of the connection of FIG. 4A with one of the half-shells applied.

FIG. 4B shows a 3-D view of the connection 200 with one of the cover shells 450 in place. The cover shell 450 may be a half-shell.

Figure 4C:
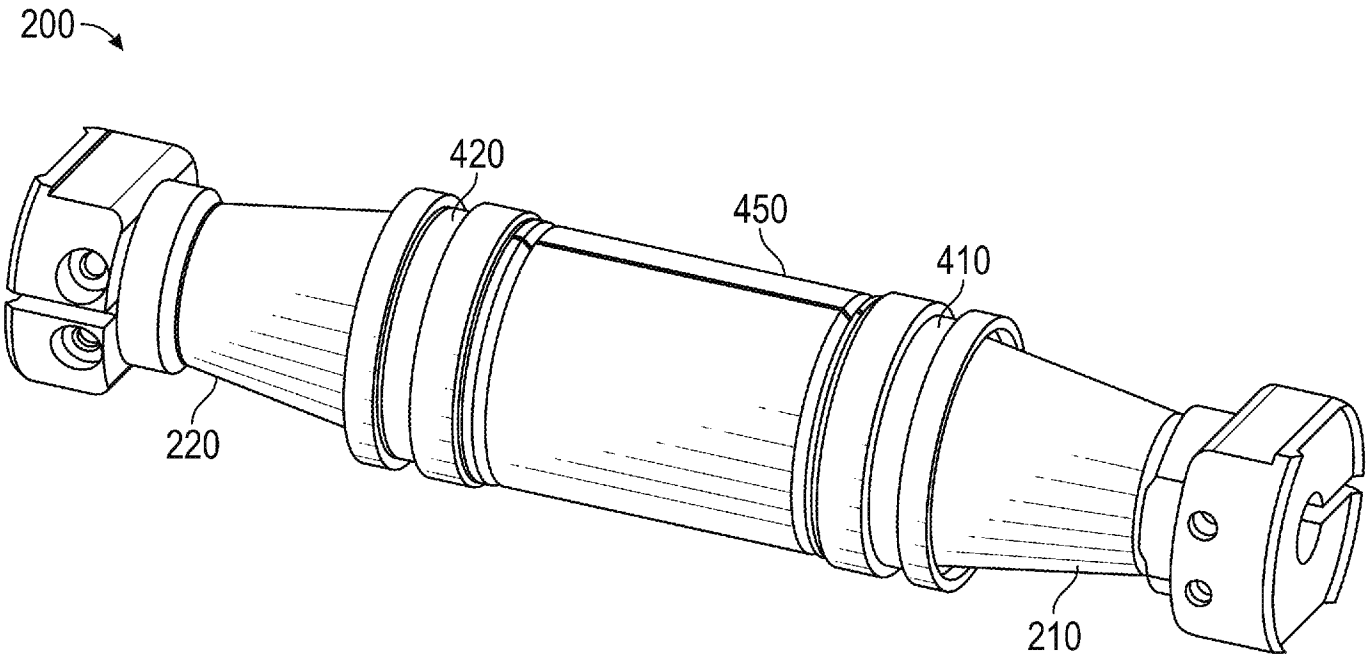
FIG. 4C is a 3-D view of the connection of FIG. 4A with both of the half-shells applied.

FIG. 4C shows a 3-D view of the connection 200 with both of the cover shells 450 in place. Once the cover shells 450 are attached, the mated tool components 180, 190 may be sleeved in a tubular housing (not shown). Contact between the interior of the tubular and the O-rings in the recessed areas 410, 420 will form a protective seal between the connection 200 and the fluids and debris of the borehole 130.

Figure 4D:
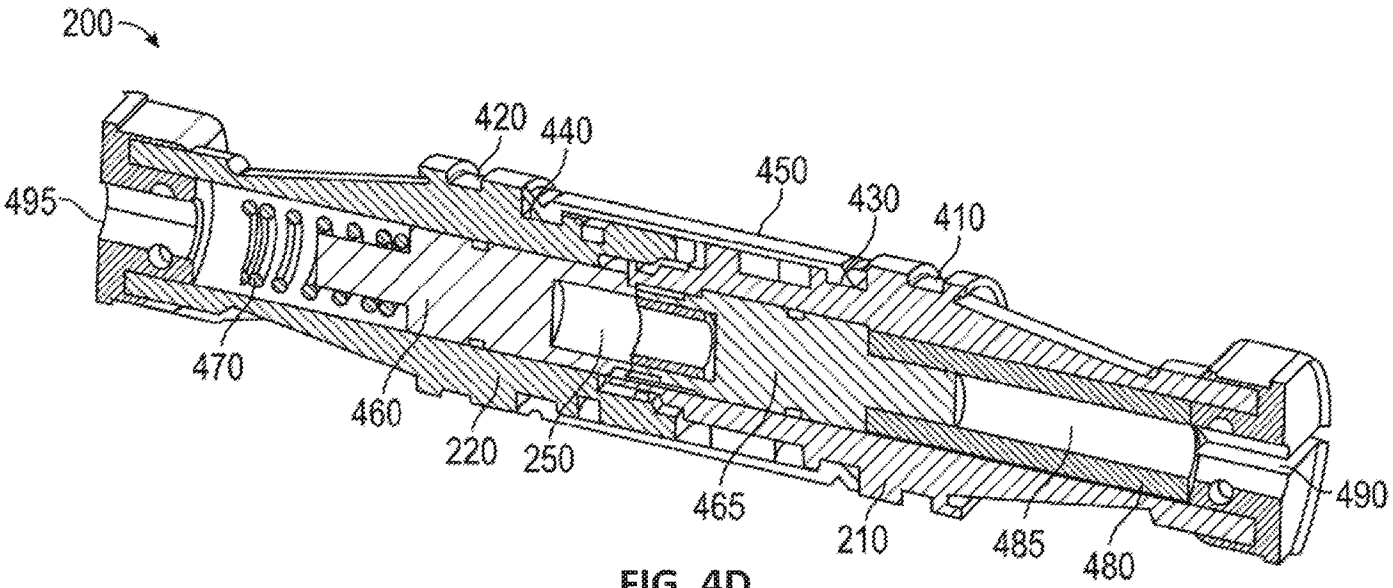
FIG. 4D is a 3-D cross-sectional view along the length of connection of FIG. 4C according to one embodiment of the present disclosure.

FIG. 4D shows a cross-sectional view along the length of the connection 200. A spring adapter 460 may be disposed between the female electrical connector 250 and the spring 470. While a spring 470 is shown, other suitable biasing elements may be contemplated, including, but not limited to an elastomeric element with a hollow allowing passage of wires through its interior. Another adapter 465 may be disposed between the male electrical connector 255 and a spacer 480. The spacer 480 may be configured to maintain the position of the male electrical connector 255 in the second connector 220, especially when force is applied by the spring 470. Thus, the spacer 480 may preload spring 470 during the connection 200. The spacer 480 may include a shaft 485 configured to allow passage of wires from the male electrical connector 255 to an exit port 490 in the second tool connector 210. Similarly, an exit port in the first tool connector 495 may aligned so that wires may pass from the female electrical connector 250 through the spring adapter 460 and the center of the spring 470.

Figure 4E:
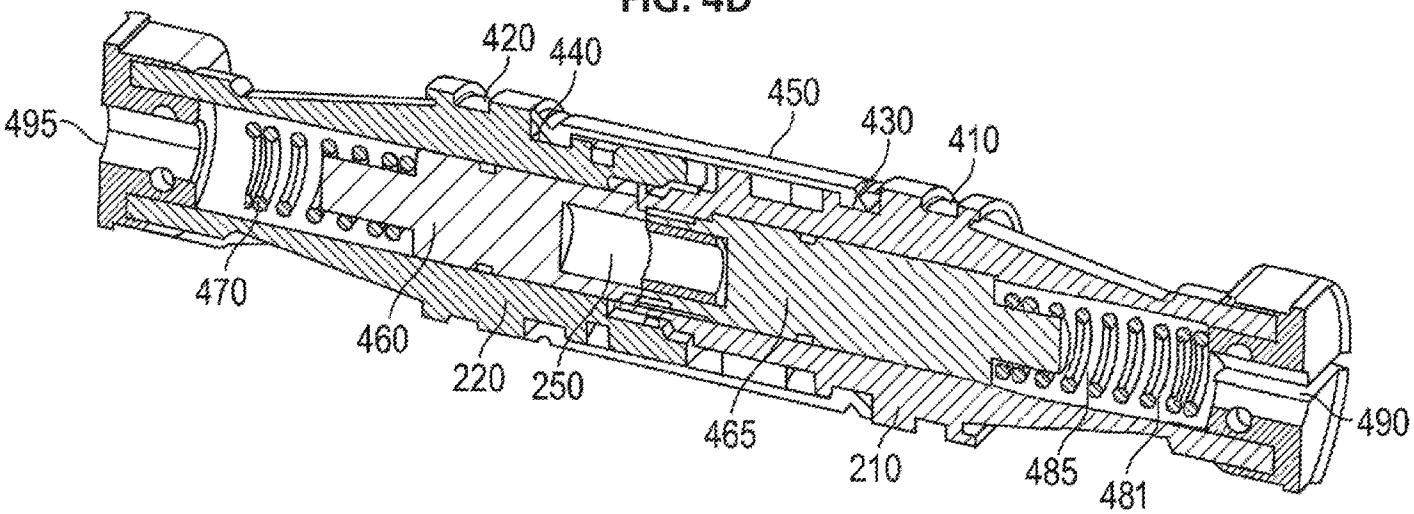
FIG. 4E is a 3-D cross-sectional view of a downhole component with a bayonet tool connector and second downhole component with a corresponding slot for mating with the bayonet tool connector according to another embodiment of the present disclosure.

Referring briefly to FIG. 4E, in some embodiments, a second spring 481 may be used in place of spacer 480. As would be understood by a person of ordinary skill in the art with the benefit of the present disclosure, the spring 470/spring adapter 460 and the spacer 480 may be reversed such that the spring 470/spring adapter 460 are disposed in the first connector 210. Thus, all 8 combinations of the complementing components are contemplated so that the male/female electrical connectors 250, 255, the bayonet plug 230/slot 240, and the spring 470/spacer 480 combinations may be implemented in any variety as long as the component complementary relationships are maintained.

Figure 5:
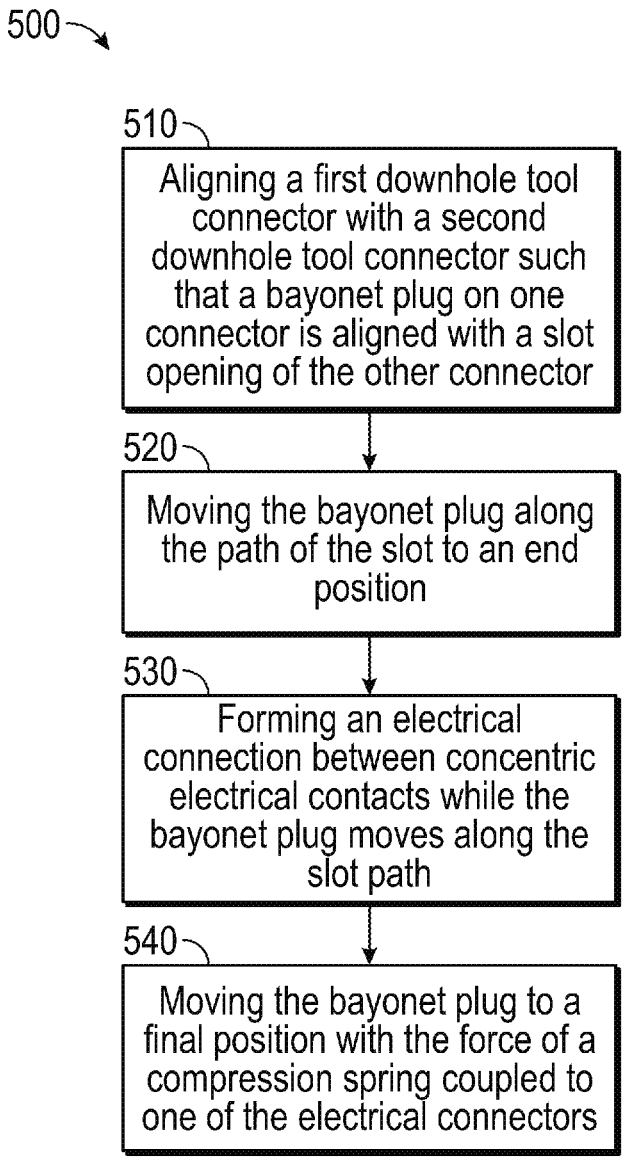
FIG. 5 is a flow chart of a method of forming an electrical connection between two downhole tools according to one embodiment of the present disclosure.

FIG. 5 shows a method 500 of forming the joint tool connection 200. In step 510, the first downhole tool connector 210 is aligned with the second downhole tool connector 220 such that the bayonet plug 230 is in the same clock position as an opening of the slot 240. In step 520, the tool connectors 210, 220 are moved relative to one another so that the bayonet plug is moved along the path of the slot to a second position. In step 530, which may take place during step 520, the electrical connectors 250, 255 move closer until they form an electrical connection. In step 540, the compression spring 470 moves the bayonet plug 230 form the second position of the slot to its locked position. In embodiments where the slot does not have a second position, the tool connection 200 may be formed without step 540. Steps 510-540 may be reversed to safely severe the connection 200.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and system, and the construction and the method of operation may be made without departing from the spirit of the disclosure.

What is claimed is:

1. An apparatus for transmitting data across a tool joint connection configured to be disposed in a borehole, the apparatus comprising:

a first data transmission element connected to a first downhole component having a first tool connector comprising a first outer surface, a first recess in the first outer surface extending circumferentially about the first tool connector, and a bayonet plug disposed on and extending away from the first outer surface of the first tool connector;

a second data transmission element connected to a second downhole component having a second tool connector comprising a second outer surface, a second recess in the second outer surface extending circumferentially about the second tool connector, and a slot configured to receive the bayonet plug of the first tool connector;

a plurality of cover shells, wherein each of the cover shells cover a portion of the first outer surface of the first tool connector and a portion of the second outer surface of the second tool connector, wherein each of the plurality of cover shells comprise:

an outer surface that is a partial cylinder;

a first inwardly extending portion that is received within the first circumferential recess of the first tool connector; and a second inwardly extending portion that is spaced apart from the first inwardly extending portion and received within the second circumferential recess of the second tool connector;

wherein the first data transmission element comprises one of a male coaxial connector and a female coaxial connector, and the second data transmission element comprises the other of the male coaxial connector and the female coaxial connector;

wherein the female coaxial connector and the male coaxial connector each comprise a plurality of concentric contacts that are all concentric to a common central axis when the male coaxial connector is received within the female coaxial connector; and wherein an electrical connection between the female coaxial connector and the male coaxial connector is formed during the formation of the tool joint connection by the mating of the first tool connector and the second tool connector.

2. The apparatus of claim 1, further comprising a circular stop ring extending away from the first outer surface of the first tool connector; and wherein the second tool connector comprises an inner cylindrical surface that is larger in diameter than the diameter of the first outer surface of the first tool connector but smaller than the outer diameter of the stop ring.

3. The apparatus of claim 2, further comprising;

a first circular recess configured to receive a first O-ring and disposed about the first tool connector;

a second circular recess configured to receive a second O-ring and disposed about the second tool connector; and wherein the plurality of cover shells and the stop ring are disposed between the first and second circular recesses.

4. The apparatus of claim 1, further comprising a compression spring disposed with one of the data transmission elements and configured to maintain an electrical connection between the data transmission elements.

5. The apparatus of claim 4, further comprising:

a second compression spring disposed on the other of the data transmission elements and configured to maintain the electrical connection between the data transmission elements.

6. The apparatus of claim 1, wherein the plurality of cover shells comprise two half-shells.

7. The apparatus of claim 1, wherein each of the female and male coaxial connectors comprises three or more concentric contacts.

8. The apparatus of claim 7, wherein each of the female and male coaxial connectors comprises four or more concentric contacts.

9. A method for forming a joint tool connection configured to be disposed in a borehole, wherein the joint tool connection comprises:

a first data transmission element connected to a first downhole component having first tool connector comprising a first outer surface, a first recess in the first outer surface extending circumferentially about the first tool connector, and a bayonet plug disposed on and extending in the radial direction away from the first outer surface of the first tool connector; and a second data transmission element connected to a second downhole component having a second tool connector comprising a second outer surface, a second recess in the second outer surface extending circumferentially about the second tool connector, and a slot configured to receive the radially-extending bayonet plug of the first tool connector;

wherein the first data transmission element comprises one of a male coaxial connector and a female coaxial connector, and the second data transmission element comprises the other of the male coaxial connector and the female coaxial connector;

wherein the female coaxial connector and the male coaxial connector each comprise a plurality of concentric contacts that are all concentric to a common central axis when the male coaxial connector is received within the female coaxial connector; and wherein an electrical connection between the female coaxial connector and the male coaxial connector is formed during the formation of the tool joint connection by the mating of the first tool connector and the second tool connector;

the method comprising:

moving the bayonet plug along a path formed by the slot from a first position to a second position; and slidingly engaging the plurality of concentric contacts on the male coaxial connector with the plurality of concentric contacts on the female coaxial connector during the moving of the bayonet plug; and positioning a plurality of cover shells about a portion of the first outer surface of the first tool connector and a portion of the second outer surface of the second tool connector, wherein each of the cover shells comprises:

an outer surface that is a partial cylinder;

a first inwardly extending portion and a second inwardly extending portion that is spaced apart from the first inwardly extending portion; and wherein the positioning comprises placing the first inwardly extending portion within the first circumferential recess of the first tool connector and placing the second inwardly extending portion within the second circumferential recess of the second tool connector.

10. The method of claim 9, further comprising:

moving the bayonet plug from a second position to a locked position and compressing a spring during the movement to the locked position.

11. The method of claim 9, wherein the step of moving the bayonet plug to the second position comprises rotating the first tool connector and the second tool connector relative to one another.

* * * * *